United States Patent [19]

Paik et al.

[11] Patent Number: 4,940,868

[45] Date of Patent: Jul. 10, 1990

[54] INSULATING FOOD ITEMS WRAPPED IN METALLIC FOIL FROM A GRID IN A MICROWAVE OVEN

[75] Inventors: Sanghoon Paik, Euiwang; Seokwon Hong, Suwon, both of Rep. of Korea

[73] Assignee: SamSung Electronics Co., Ltd., Kyung Ki-Do, Rep. of Korea

[21] Appl. No.: 400,821

[22] Filed: Aug. 30, 1989

[30] Foreign Application Priority Data

Dec. 30, 1988 [KR] Rep. of Korea ..... 88-22127

[51] Int. Cl.[5] ..... H05B 6/80

[52] U.S. Cl. ..... 219/10.55 E; 219/10.55 F; 99/DIG. 14; 126/337 R

[58] Field of Search ..... 219/10.55 E, 10.55 F, 219/10.55 D, 10.55 R; 99/DIG. 14, 451, 449; 126/337 R, 337 A, 339

[56] References Cited

U.S. PATENT DOCUMENTS

| | | | |
|---|---|---|---|
| 4,033,009 | 7/1977 | Hoinash | 99/DIG. 14 |
| 4,455,467 | 6/1984 | Dills | 219/10.55 E |
| 4,511,779 | 4/1985 | Bucksbaum et al. | 219/10.55 E |
| 4,558,198 | 12/1985 | Levendusky et al. | 219/10.55 E |
| 4,653,461 | 3/1987 | Eke | 219/10.55 E |
| 4,868,360 | 9/1989 | Duncan | 219/10.55 E |

*Primary Examiner*—Philip H. Leung

*Attorney, Agent, or Firm*—Robert E. Bushnell

[57] ABSTRACT

Disclosed is an insulation plate for insulating food items wrapped in metallic foil from a grid in a microwave oven, the insulation plate has a pair of elongate element with an arcuate shape, an element including a L shaped protrusion that discourages edgeways movement of the grip, a plurality of supporting protrusions that discourage movement to the center of the grid, and a plurality of L shaped support that prevents upward lifting.

20 Claims, 5 Drawing Sheets

INSULATING FOOD ITEMS WRAPPED IN METALLIC FOIL FROM A GRID IN A MICROWAVE OVEN

BACKGROUND OF THE INVENTION

1. Field of the Invention

The present invention relates to an assistant insulation plate for insulating a food wrapped with metallic foil. More particularly, it relates to an assistant insulation plate which is used on a grid of microwave oven.

The plate being especially designed to form an a pair of elongate elements having arc type.

The plate also prevents the food wrapped with foil from an electric spark in operating the microwave oven because the element is made of an electrically insulative and elastic material.

2. Related Art

Most convention microwave ovens utilize a tray or a grid for cooking food. To leave frozen food wrapped with aluminium foil to thaw or to heat the cooked food wrapped with aluminium foil, it is necessary to put the food on the tray of the microwave oven and to turn the power switch on. In this case, if the aluminium foil comes in contact with an inner wall of the microwave oven carelessly, the magnetron of the microwave oven is damaged by electric spark.

Recently, a rack type insulation plate was used to prevent said aluminum foil from electric spark as in FIG. 5.

FIG. 5 is a perspective view as an exploded state applying to the prior art.

In FIG. 5, a rack type insulation plate 22 is located on a gird 21 and the grid is put on a tray 20. If a person is to cook food wrapped with aluminium foil on the insulation plate 22, it can be cooked safely regardless of the contact. As the insulation plate 22 is put on the grid 21 as a separated state, it is necessary to put the plate on the grid while cooking. And also it is hard to form a rack type insulation plate as a honeycomb style.

SUMMARY OF THE INVENTION

The object of the present invention is to provide a safe cooking utensil with two insulation means.

The other object of the present invention is to set the insulation means without movement at a steel wire of a grid.

The insulation means are formed arcuate shape as an elongate element respectively and supported by supporting means.

Said supporting means has two L shaped protrusions at its both ends, a few supporting protrusion at a reverse side of the element and a plurality of L shaped supporter at a convex side of the element.

BRIEF DESCRIPTION OF THE INVENTION

The foregoing and other objection, features and advantages of the present invention should become apparent from the following description taken in conjunction with the accompanying drawings in which.

DETAILED DESCRIPTION OF THE PREFERRED EMBODIMENT

Figure 1:
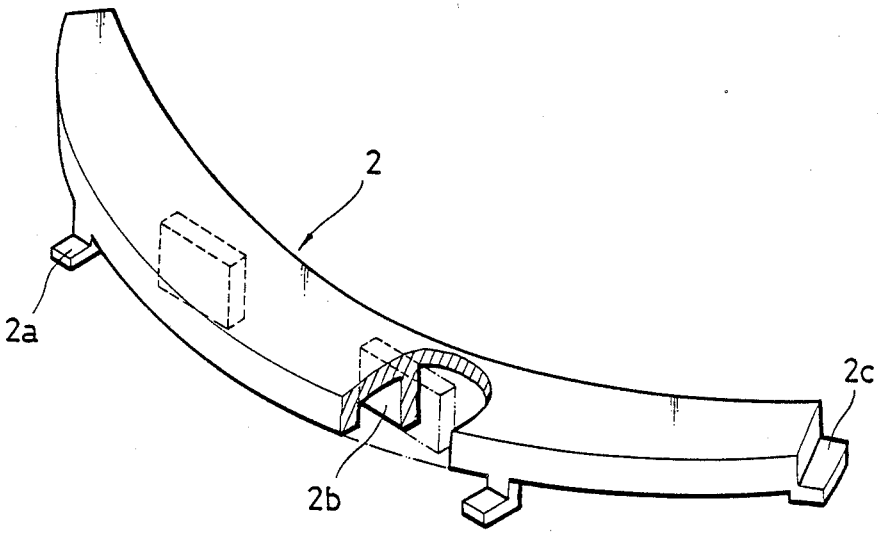
FIG. 1 is a partially cutaway view of an elongate element of insulation means.

Referring first to FIG. 1, an insulation means 2 is shown. Supporting means are formed at the arcuate shaped elongate element.

The insulation means 2 comprise a pair of elongate elements.

L shaped protrusions 2*c* are formed at both ends of the elongate element as a part of the supporting means.

A plurality of supporting protrusions 2*b* are attached at. L shaped supporter 2*a* is attached at a convex side of the element to the same secant direction with supporting protrusions 2*b*.

Figure 5:
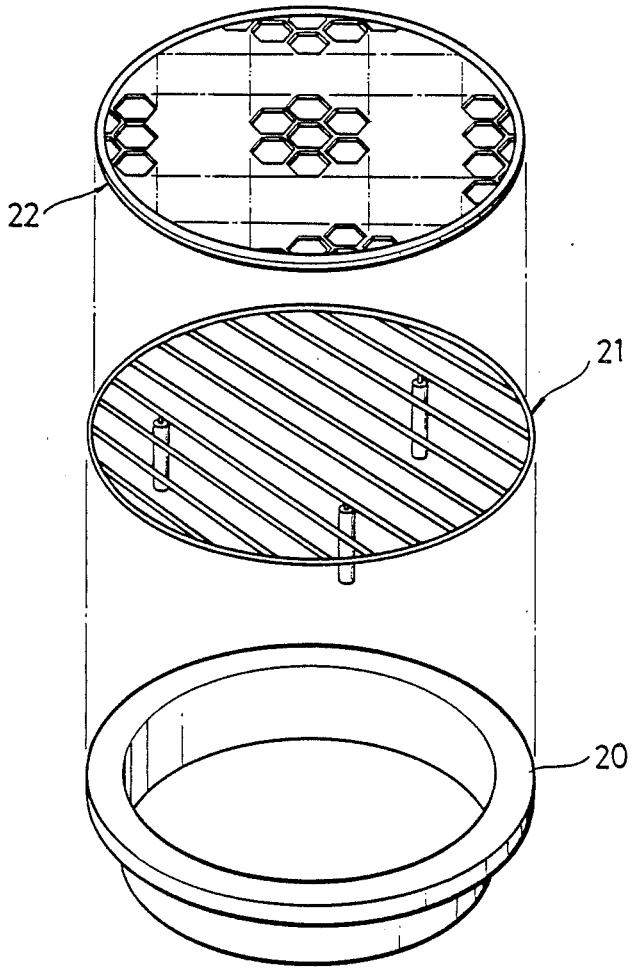
FIG. 5 PRIOR ART
FIG. 5 is a perspective view of the prior art.

Elongate insulator 2 is made of a material that exhibits elasticity. This insulator 2 is represented as in FIGS. 2 and 3 instead of a rack type insulation plate 22 of FIG. 5. A grid 1 composed of steel wires 1*a* and edge wire 1*a'* is put on a tray 3.

Two elongate elements are fixed at the wires 1*a*, 1*a'*.

Figure 2:
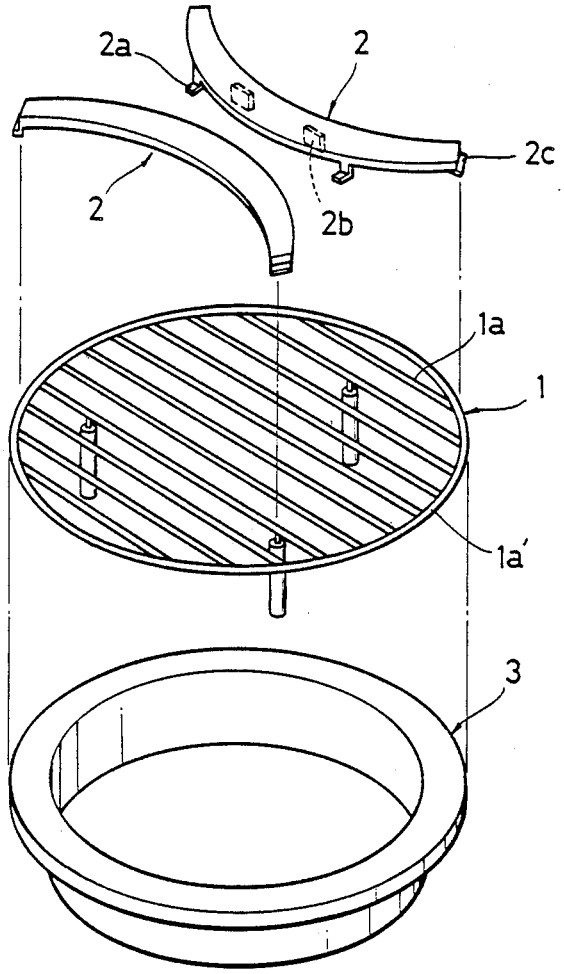
FIG. 2 is an exploded view of the insulation means corresponding to a grid and a tray.
Figure 3:
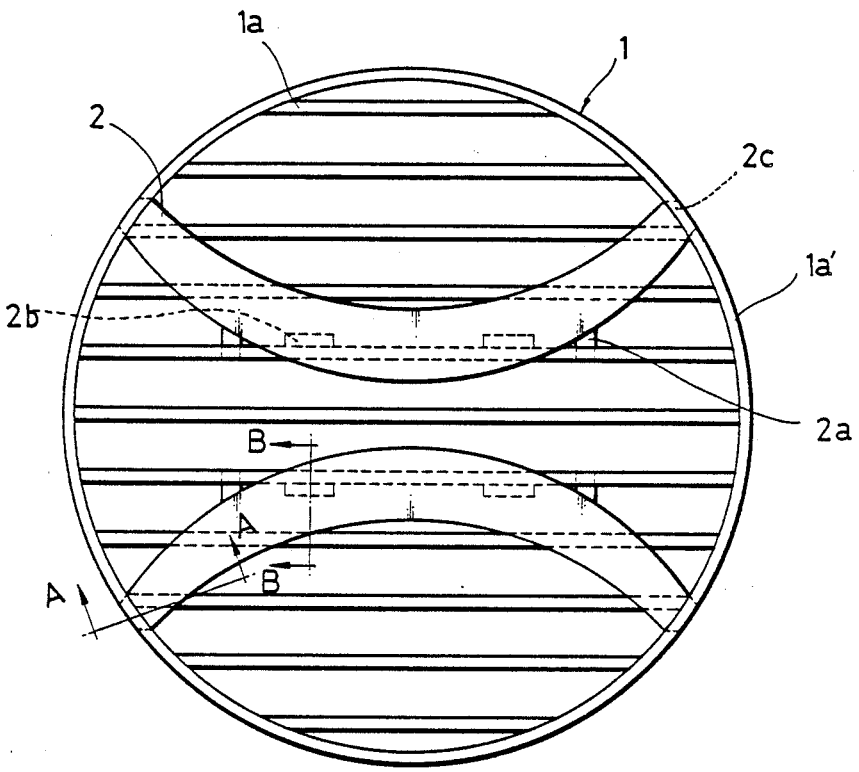
FIG. 3 is a fragmentary plan view as an assembled state on the grid.

FIG. 2 is an exploded view but, it is explained as an assembled state as in FIG. 3 for the convenience of explanation.

Figure 4A:
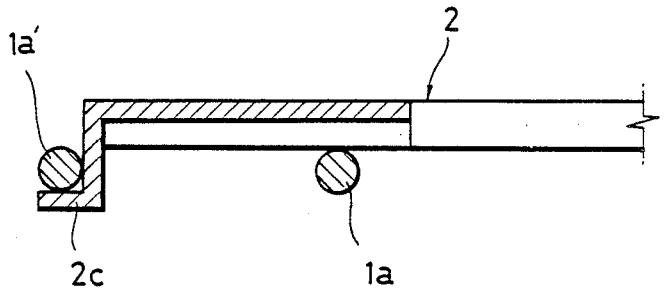
FIG. 4A is a vertical sectional view taken along line A—A in FIG. 3.

In use, L shaped protrusions 2*c* are fixed below edge wire 1*a'* as in FIGS. 3 and 4A. It prevents the insulator 2 from moving edgeways of the grid.

Figure 4B:
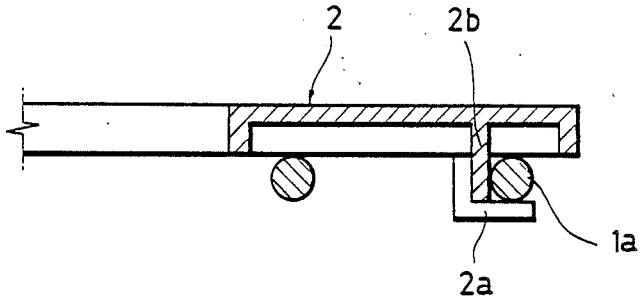
FIG. 4B is a vertical sectional view taken along line B—B in FIG. 3.

Supporting protrusions 2*b* are positioned beside one of a steel wire 1*a* as in FIGS. 3 and 4B. It prevents the insulator 2 from moving to the center of the grid 1. L shaped supporters 2*a* are positioned below the steel wire 1*a* as in FIGS. 3 and 4B. It prevents the insulation means 2 from lifting upwards.

Said L shaped supporters 2*a* and supporting protrusions 2*b* are formed to a same secant direction of the element.

In separating the insulation means 2, as the insulation means 2 are made of an elastic material, the supporting means 2*a*, 2*b* and 2*c* are easily separated by lifting the insulation means 2 from the grid 1.

In cooking, the insulation means are settled on the grid by the supporting means as in FIG. 3.

If food wrapped with an aluminium foil is supported on the insulation means, the insulation means prevent the aluminium foil from sparking by the contacting to an inner side wall of the microwave oven.

Because the insulation means insulate the foil from the main body.

As mentioned above, if the microwave oven is not used, present invent can function on the grid as a fixing state. And also, it can be separated easily from the grid due to the flexible characteristic of elastic material.

While preferred embodiments have been set forth, various modifications, alterations, and changes may not be made without departing from the spirit and scope of the present invention as defined in the appended claims.

What is claimed is:

1. An insulation plate for insulating a food item wrapped in a metallic foil from a grid in a microwave oven, comprising:

a pair of elongate elements having an arcuate shape, said elements being made of an electrically insulating and elastic material; and support means adjoining said the term elongate elements for preventing said elements from moving edgewise or to center of a grid supporting said elements, and for preventing said elements from lifting upwards from the grid;

whereby said support means engages the grid and thereby prevents the insulation plate from separating from the grid, while the insulation plate prevents the metallic foil from causing sparking within the microwave oven.

2. The insulation plate of claim 1, wherein the supporting means further comprises:

L-shaped protrusion means attached to the both ends of the elongate elements, for preventing the elongate elements from moving edgeways of the grid;

a plurality of supporting protrusion means attached to undersides of the elongate elements, for preventing the elongate elements from moving to the center of the grid; and a plurality of L shaped support means attached at a convex face of the elongate elements and extending in a secant direction with said supporting protrusion means from a convex side of the elements, for preventing said elongate elements from lifting upward.

3. The insulation plate of claim 2, wherein each of said elongate elements is comprised of a unitary structure including said L-shaped protrusion means, supporting protrusion means and L-shaped support means.

4. The insulation plate of claim 2, wherein said L-shaped protrusion means, supporting protrusion means and L-shaped support means of each of said elongate elements being mutually spaced apart.

5. The insulation plate of claim 1, wherein each of said elongate elements is a discrete, unitary structure made of said electrically insulating and elastic material.

6. An insulation plate for insulating a food item wrapped in, comprising:

a metallic foil for cooking in a microwave oven a plurality of discrete elongate elements each having an arcuate inner major side and an arcuate outer major side terminated at opposite ends by end members, said end members each including a first protrusion extending in a first direction below and in a second direction beyond, said inner and outer major sides, each of said elongate elements having a plurality of intermediate members including a second protrusion extending in said first direction below and in a third direction beyond, one of said inner and outer major sides, and each of said elongate elements having a depending member spaced apart from said end and intermediate members and extending in said first direction below said inner and outer major sides.

7. The insulation plate of claim 6, wherein each of said discrete elongate elements is made of an elastic, electrically insulating material.

8. The insulation plate of claim 7, wherein each of said discrete elongate elements is comprised of a unitary structure including said end, intermediate and depending members.

9. The insulation plate of claim 8, wherein said end members, intermediate members and depending member of each of said elongate elements being mutually spaced apart.

10. The insulation plate of claim 7, wherein said end members, intermediate members and depending member of each of said elongate elements being mutually spaced apart.

11. The insulation plate of claim 6, wherein each of said discrete elongate elements is comprised of a unitary structure including said end, intermediate and depending members.

12. The insulation plate of claim 6, wherein said end members, intermediate members and depending member of each of said elongate elements being mutually spaced apart.

13. The insulation plate of claim 6, wherein:

said end members comprise L-shaped protrusions attached to both ends of each of said elongate elements;

each of said depending member comprises a supporting protrusion attached to underside of each of said elongate elements; and said intermediate members comprise a plurality of L-shaped supports extending in a common direction from one of said major and minor sides of said elongate elements.

14. The insulation plate of claim 13, wherein each of said discrete elongate elements is made of an elastic, electrically insulating material.

15. The insulation plate of claim 13, wherein each of said discrete elongate elements is comprised of a unitary structure including said end, intermediate and depending members.

16. The insulation plate of claim 13, wherein said end members, intermediate members and depending member of each of said elongate elements being mutually spaced apart.

17. A rack for insulating a food item wrapped in a metallic foil for cooking in a microwave oven, comprising:

a grid having a peripheral member defining a planar area and a plurality of horizontally extending members joined to and arrayed across said planar area;

means disposable beneath said grid, for supporting said grid within a microwave oven; and a plurality of discrete elongate elements positionable upon said grid, with each of said elongate elements having an arcuate inner major side and an arcuate outer major side terminated at opposite ends by end members, said end members each including a first protrusion extending in a first direction below and in a second direction beyond, said inner and outer major sides and engaging said grid;

each of said elongate elements having a plurality of intermediate members including a second protrusion extending in said first direction below and in a third direction beyond, one of said inner and outer major sides, and engaging said rack; and each of said elongate elements having a depending member spaced apart from said end and intermediate members and extending in said first direction below said inner and outer major sides and between said horizontally extending members.

18. The rack of claim 17, wherein each of said discrete elongate elements is made of an elastic, electrically insulating material.

19. The rack of claim 17, wherein each of said discrete elongate elements is comprised of a unitary structure including said end, intermediate and depending members.

20. The rack of claim 17, wherein said end members, intermediate members and depending member of each of said elongate elements being mutually spaced apart.

* * * * *